US006938726B1

(12) United States Patent
Roark et al.

(10) Patent No.: US 6,938,726 B1
(45) Date of Patent: Sep. 6, 2005

(54) FIELD REBUILDABLE LOW FREQUENCY LOUDSPEAKER DRIVER HAVING A REMOVABLE DIAPHRAGM ASSEMBLY, PARTS KIT AND METHOD FOR REBUILDING A LOUDSPEAKER DRIVER IN THE FIELD

(75) Inventors: Richard S. Roark, Clarksville, TN (US); Daniel F Roemer, Madison, WI (US)

(73) Assignee: Mitek Corporation, Winslow, IL (US)

( * ) Notice: Subject to any disclaimer, the term of this patent is extended or adjusted under 35 U.S.C. 154(b) by 208 days.

(21) Appl. No.: 10/272,022

(22) Filed: Oct. 16, 2002

(Under 37 CFR 1.47)

Related U.S. Application Data

(60) Provisional application No. 60/329,581, filed on Oct. 16, 2001.

(51) Int. Cl.[7] ..... G10K 11/00

(52) U.S. Cl. ..... 181/171

(58) Field of Search ..... 181/172, 171, 181/148, 153, 154, 155, 157, 160, 161, 164, 165, 166

(56) References Cited

U.S. PATENT DOCUMENTS

| | | | | |
|---|---|---|---|---|
| 1,831,235 A | | 10/1931 | Farrow | |
| 1,877,085 A | | 9/1932 | Trefry | |
| 3,767,004 A | | 10/1973 | Liebscher | |
| 3,892,289 A | | 7/1975 | Rollins | |
| 5,099,949 A | | 3/1992 | Mitobe | |
| 5,111,510 A | | 5/1992 | Mitobe | |
| 5,687,247 A | * | 11/1997 | Proni | 381/398 |
| 5,757,945 A | | 5/1998 | Sakamoto | |
| 5,850,462 A | | 12/1998 | Sakamoto et al. | |
| 5,949,898 A | * | 9/1999 | Proni | 381/398 |
| 6,343,136 B2 | | 1/2002 | Tokusho et al. | |

* cited by examiner

*Primary Examiner*—Kimberly Lockett
(74) *Attorney, Agent, or Firm*—Jones, Tullar & Cooper PC

(57) ABSTRACT

A rebuildable low frequency loudspeaker driver has a replaceable diaphragm assembly. In a first embodiment, the peripheral edge of a loudspeaker driver diaphragm comprises a flexible surround and is releaseably supported within a matching basket having a peripheral mounting flange clamping surface to which a rigid ring-shaped clamping member or gasket is releaseably attached. A parts kit includes a replacement cone assembly with a frustoconical cone having an attached annular surround at the large cone end and a flexible spider attached near the small cone end, adjacent the attachment point for the cylindrical voice coil former. The spider includes a rigid ring mounted at the spider peripheral edge and dimensioned to be removably fastened to the driver basket. The driver basket includes a spider plateau region including a valley with sidewalls adapted to receive and center the spider rigid ring. The rebuilding method includes the steps of removing the expended cone assembly, cleaning the magnetic gap (if necessary) aligning the replacement cone assembly voice coil former over the motor pole piece, fastening the spider ring, removing the spacer paper alignment tool, and gluing a new dust cover over the center of the cone.

16 Claims, 10 Drawing Sheets

FIELD REBUILDABLE LOW FREQUENCY LOUDSPEAKER DRIVER HAVING A REMOVABLE DIAPHRAGM ASSEMBLY, PARTS KIT AND METHOD FOR REBUILDING A LOUDSPEAKER DRIVER IN THE FIELD

PRIOR APPLICATION INFORMATION

This application claims priority from provisional application 60/329,581, filed Oct. 16, 2001, the entire disclosure of which is incorporated herein by reference.

BACKGROUND OF THE INVENTION

1. Field of the Invention

The present invention relates to transducers for sound reproduction, and, more particularly, to low frequency loudspeaker drivers, conventionally referred to as woofers.

2. Discussion of the Prior Art

A great variety of moving coil loudspeaker designs have been proposed for high quality low frequency sound reproduction, many have gone into commercial use. These are typically included in a modern full range loudspeaker system utilizing different speakers for different segments of the sound spectrum. For example, a "woofer" is used for bass or low frequencies, a mid-range speaker is used for intermediate frequencies and a "tweeter" is used for the highest frequencies in the reproduced spectrum.

It is generally accepted that loudspeakers with sufficient size to produce adequate bass have well understood limitations. In particular, high power signals driving the cone into extreme excursions cause poor sound reproduction when driven by more challenging audio signals.

Typical prior art woofers utilize circular baskets supporting frustoconical driver diaphragms having a circular peripheral edge carrying an annular surround or suspension. Customarily, the circular small end of the frustoconical diaphragm supports a cylindrical voice coil former upon which is wound a conductive voice coil having positive and negative terminal ends. Conventional woofers utilize baskets which closely follow the frustoconical shape of the driver diaphragm and support the motor magnet and the circular diaphragm surround in an co-axial alignment, permitting the axial movement of the diaphragm in response to electrical excitation of the voice coil.

In some high-end automotive or twelve volt applications, music afficionados and auto-sound competitors will install several woofers in a two-dimensional array on a baffle or enclosure surface; for example, it may be desirable to install four or six woofers in two rows of two or three.

Another concern for music afficionados and auto-sound competitors is woofer failure due to thermal or mechanical overloading problems. Substantial amounts of power are required to provide competition-winning sound pressure levels, often well over 150 decibels (dB). Signals having such power require very large current flow through voice coil conductors, thus generating substantial amounts of heat, and drive the woofers to extreme excursions, thus generating extreme mechanical loads on diaphragms and suspensions.

In Sound Pressure Level (SPL) competitions, competitors seek the loudest possible playback and often over-drive the loudspeaker drivers, causing voice coils to burn out or open circuit. Such extreme use (or abuse) may also cause mechanical failure of the cone, the surround, or the "spider" suspension member. Competitors have become accustomed to replacing failed drivers, often accumulating piles of failed drivers during the course of a competition.

In order to overcome these perceived difficulties, the inventor has developed a number of new woofer configurations and parts configurations.

OBJECTS AND SUMMARY OF THE INVENTION

Accordingly, it is a primary object of the present invention to overcome the above mentioned difficulties by providing a rebuildable woofer structure having a readily removable and replaceable diaphragm assembly, preferably supported within a basket having a basket flange and motor front face adapted to receive removable fasteners for clamping the diaphragm assembly into place.

Another object of the present invention is to provide a woofer configuration which permits removable mounting of a woofer diaphragm assembly in the field, as during a competition.

Yet another object of the present invention is to provide a woofer adapted to receive parts from a kit including a replacement diaphragm assembly which the user may readily replace in the field, thus preventing accumulation of waste loudspeaker drivers.

The aforesaid objects are achieved individually and in combination, and it is not intended that the present invention be construed as requiring two or more of the objects to be combined unless expressly required by the claims attached hereto.

A rebuildable low frequency loudspeaker driver has a replaceable diaphragm assembly. In a first embodiment of the present invention, the peripheral edge of a loudspeaker driver diaphragm comprises a flexible surround and is releaseably supported within a matching basket having a peripheral mounting flange clamping surface to which a rigid ring-shaped gasket or clamping member is releaseably attached.

A parts kit includes a replacement cone assembly with a frustoconical cone having an attached annular surround at the large cone end and a flexible spider attached near the small cone end, adjacent the attachment point for the cylindrical voice coil former which carries a spacer paper alignment tool inside the former. The spider includes a rigid ring mounted at the spider peripheral edge and dimensioned to be removably fastened to the driver basket. The driver basket includes a spider plateau region including a valley with sidewalls adapted to receive and center the spider rigid ring.

The rebuilding method includes the steps of unfastening the rigid ring-shaped gasket, unfastening the spider ring, removing the expended cone assembly, cleaning the magnetic gap (if necessary), aligning the replacement cone assembly spacer paper alignment tool and voice coil former over the driver motor pole piece, fastening the spider ring, removing the spacer paper alignment tool, and gluing a new dust cover over the center of the cone.

In an alternative embodiment of the low frequency loudspeaker driver of the present invention, the configuration of the replaceable cone assembly includes rigid rings or gaskets on both the spider and the cone peripheral surround.

The above and still further objects, features and advantages of the present invention will become apparent upon consideration of the detailed description of specific embodiments thereof, particularly when taken in conjunction with the accompanying drawings, wherein like reference numerals in the various figures are utilized to designate like components.

DETAILED DESCRIPTION OF THE PREFERRED EMBODIMENTS

Figure 1:
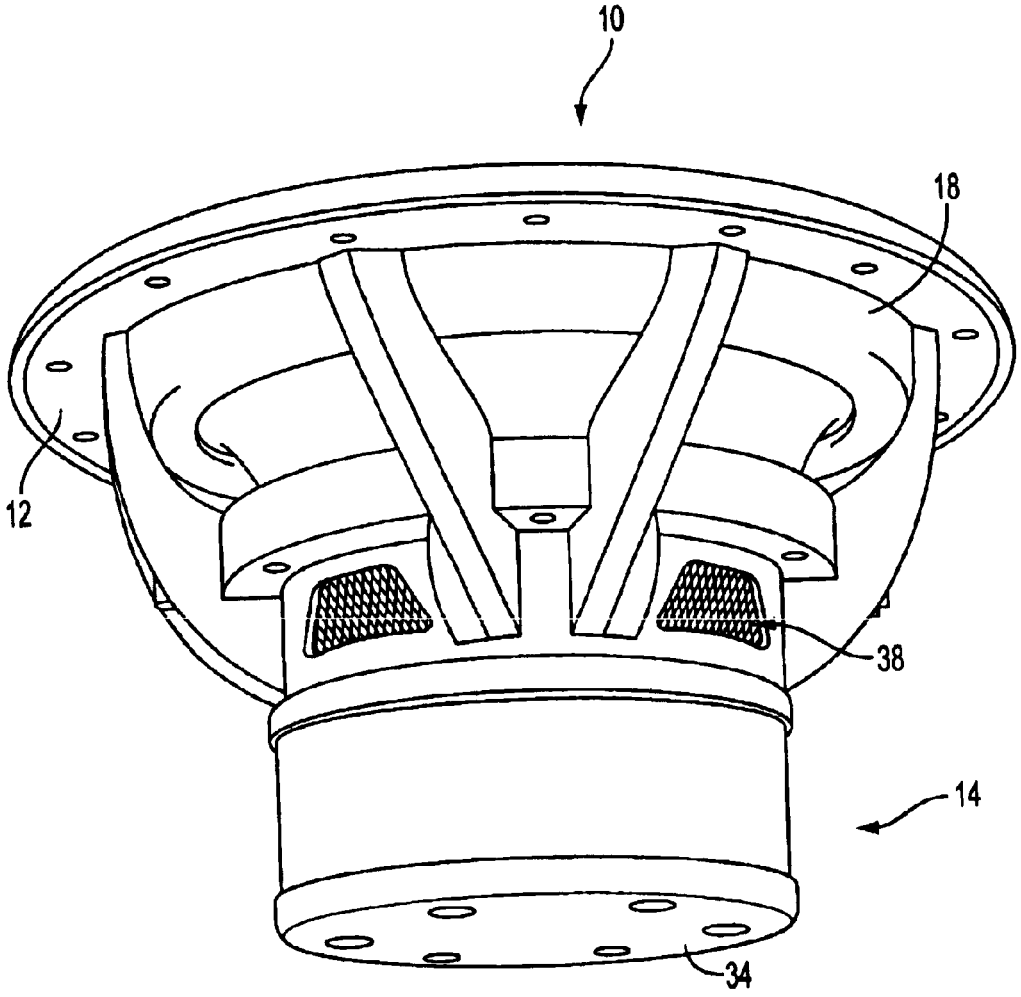
FIG. 1 is a perspective view, in elevation, of a field rebuildable loudspeaker driver or competition subwoofer, in accordance with the present invention
Figure 2:
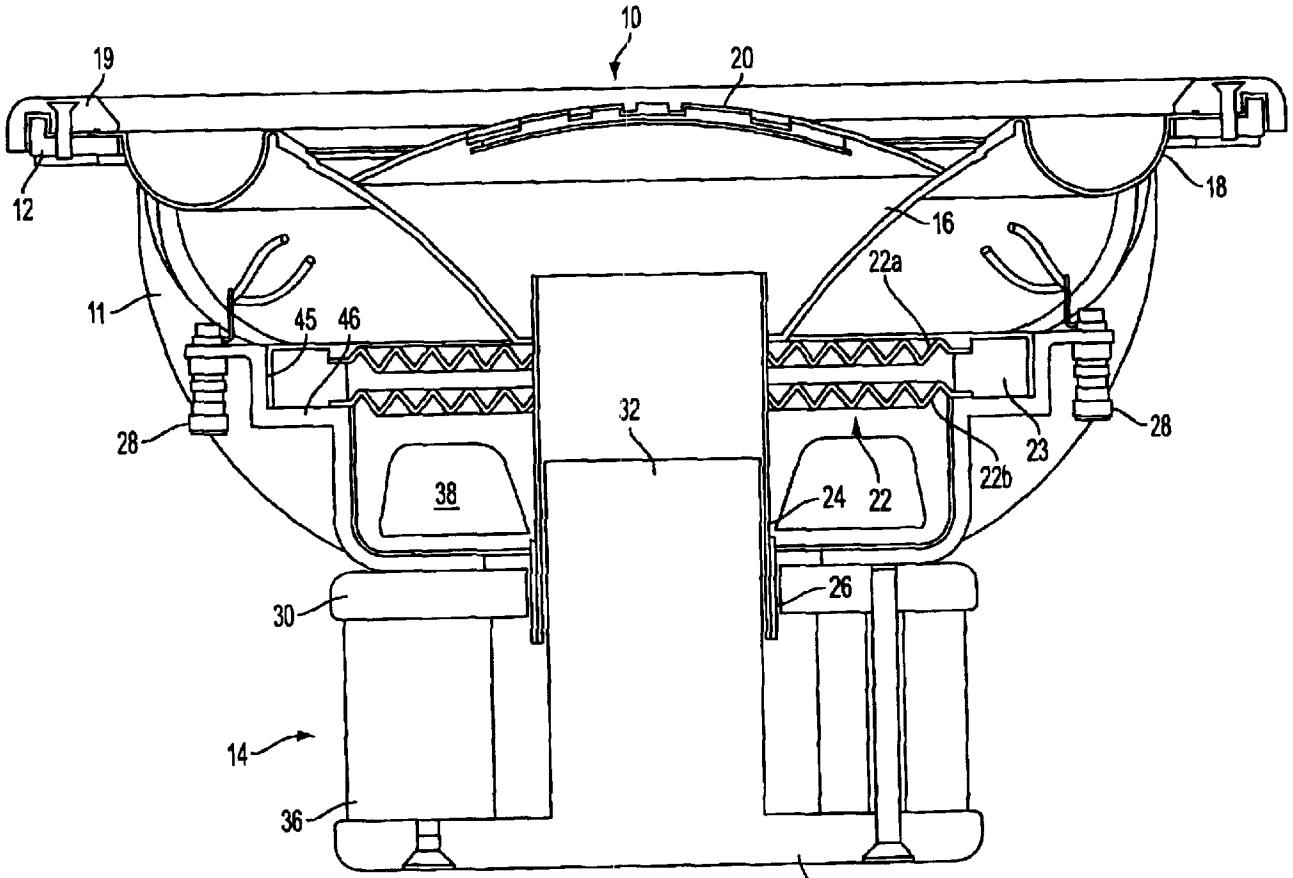
FIG. 2 is a cross sectional view, in elevation, of the field rebuildable loudspeaker driver of FIG. 1, in accordance with the present invention
Figure 3:
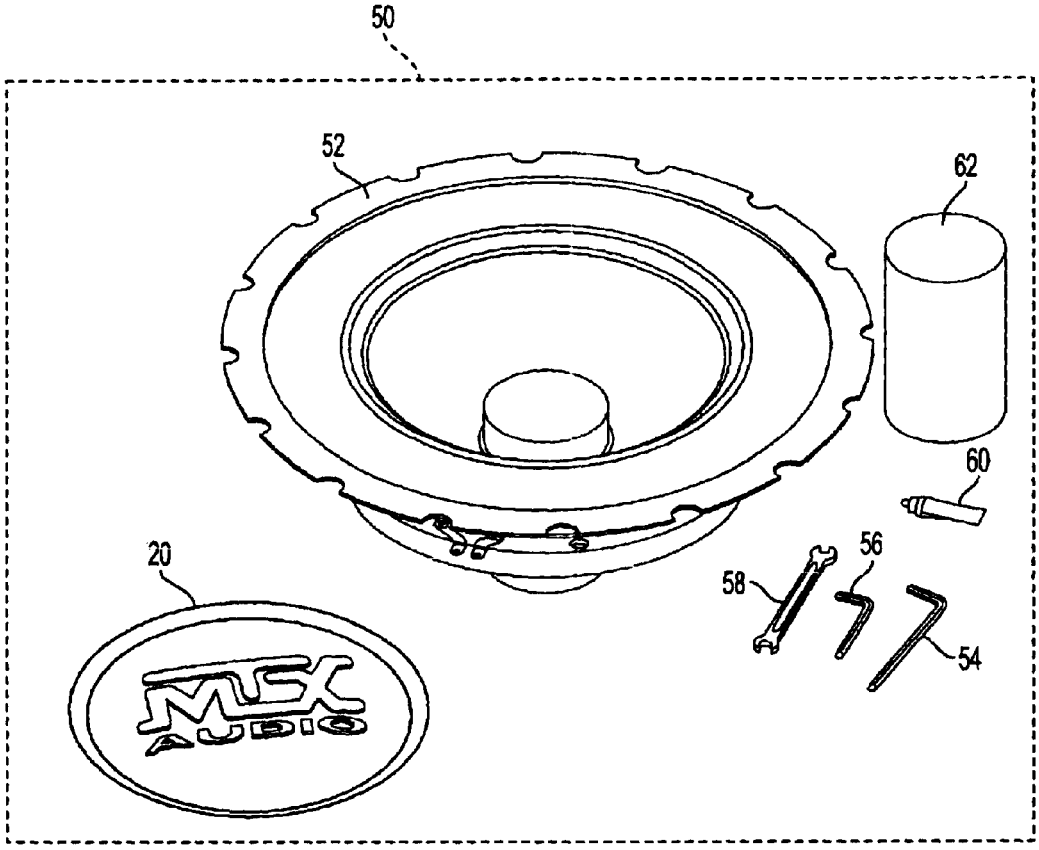
FIG. 3 is a perspective view, in elevation, of a parts kit for use with the field rebuildable loudspeaker driver of FIG. 1, in accordance with the present invention

Turning now FIGS. 1 and 2, FIG. 1 illustrates the field rebuildable fifteen inch woofer of the president invention 10 in a perspective view showing the underside of Woofer Basket 11 which terminates at the upper end or distally in basket front flange 12 forming an annular or circular planar mounting surface. At the proximal end of basket 11 is a second substantially planar annular surface adapted to receive and carry Woofer Motor 14. The cone or diaphragm 16 (as best seen in FIG. 2) has an upper or distal larger circular edge upon which is permanently affixed a flexible half roll surround 18. The outer peripheral edge of surround 18 is scalloped with semi-circular cut-out regions evenly spaced around the outside portion of the surround, as best seen in FIG. 3. The scalloped or cut out portions are dimensioned to be aligned with threaded apertures evenly spaced around basket front flange 12. Basket 11 is preferably cast from a rigid material such as a metal, preferably aluminum and is preferably painted in pleasing color such as bright red.

Figure 6:
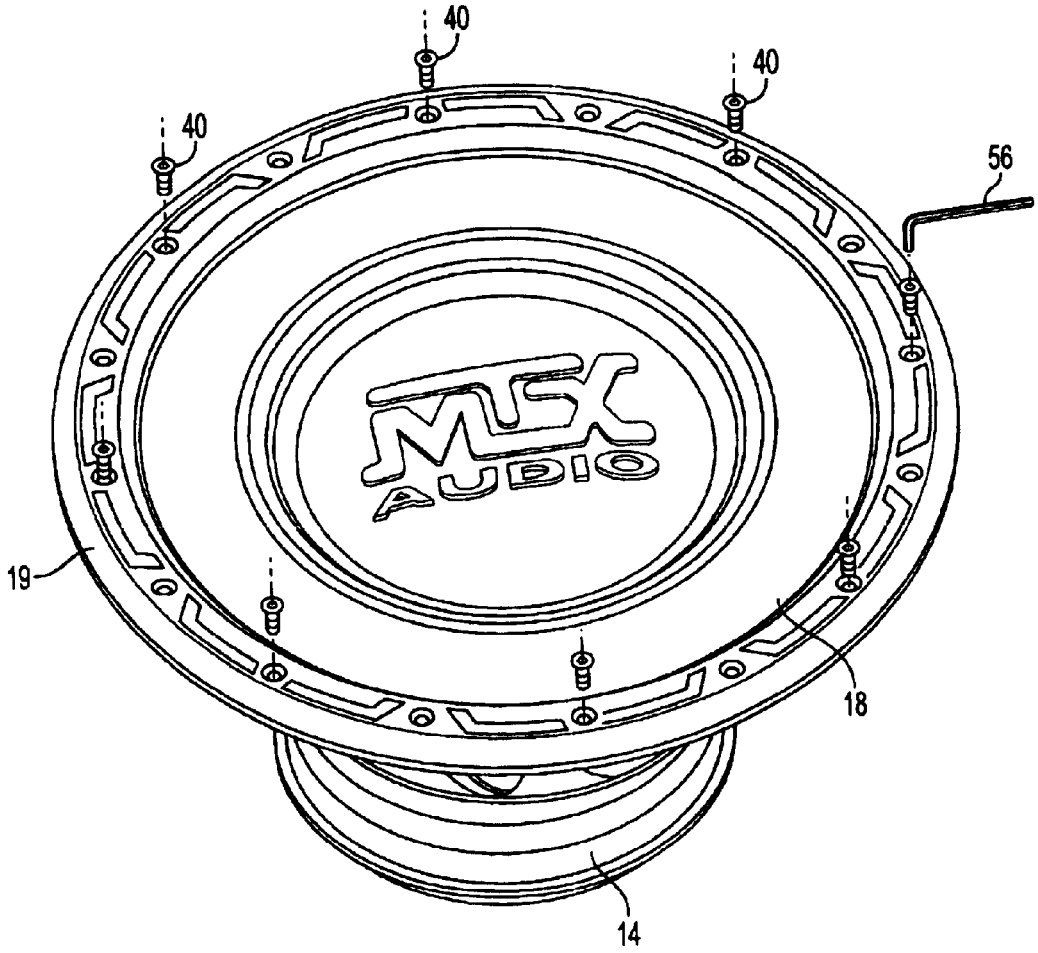
FIG. 6 is a perspective view, in elevation, of the removable, rigid front gasket of the field rebuildable loudspeaker driver of FIG. 1, illustrating part of the field replacement method of the present invention.

As best seen in FIGS. 2 and 6, basket front flange 12 preferably carries a substantially planar ridged gasket ring 19, which is attached thereto by a plurality of evenly spaced threaded fasteners 40. Preferably, the threaded fasteners are adapted to receive and be actuated by a ⅛ inch hex key 56. Preferably, eight hexhead fasteners 40 are evenly spaced around and completely penetrate through gasket ring 19 and are threadably received in blind holes machined into basket front flange 12 to permit removable clamping of cone assembly surround 18 between gasket ring 19 and basket front flange 12.

Rebuildable Woofer 10 is thereby adapted to permit removal of gasket ring 19 by, preliminarily, removal of hex fasteners 40. As best seen in FIG. 3, the scalloped semi-circular cutouts evenly spaced around the outer peripheral edge of cone assembly surround 18 are aligned with and are disposed around the holes in front flange 12 which receive the threaded fasteners 40. Rigid gasket ring 19 also includes an additional eight through holes or apertures evenly spaced between the apertures receiving hex fasteners 40 to permit longer threaded fasteners to penetrate through gasket ring 19 and through front flange 12 so that woofer 10 can be mounted in a baffle as is customarily done. Thus, front flange 12 has eight evenly spaced apertures, which penetrate completely through the planar front flange and also are aligned with similarly sized apertures in rigid gasket ring 19. The spacing of the through holes and blind holes in front flange 12 is matched with the spacing of the semi-circular scallops or cutouts arrayed around the outer peripheral edge of surround 18.

Returning to FIGS. 2, 3 and 10, a substantially dome-shaped dust cap 20 having a circular outer peripheral edge is affixed (e.g. by a glue joint) to cone 16 and covers and protects a tube-shaped or substantially cylindrical voice coil former 12 which is attached to the small opening of cone 16. As is customary, at least one electrically conductive voice coil 26 having two ends (plus and minus) is wound around voice coil former 24; the voice coil ends (plus and minus) are each electrically connected to a single terminal connector 28 by an releasable electrical connection. In the preferred embodiment, first and second voice coils are wound on former 24, and each voice coil has its ends terminated in a single terminal connector 28, and so four terminal connectors 28 are mounted on basket 11. Each of the terminals is carried by and supported on a horizontal and planar flange incorporated into basket 11 and the connective portions of each of the terminal connectors are electrically insulated from the rigid basket material by the use of insulating spacers or terminal bases which align and support the basket terminal connectors 28.

Figure 8:
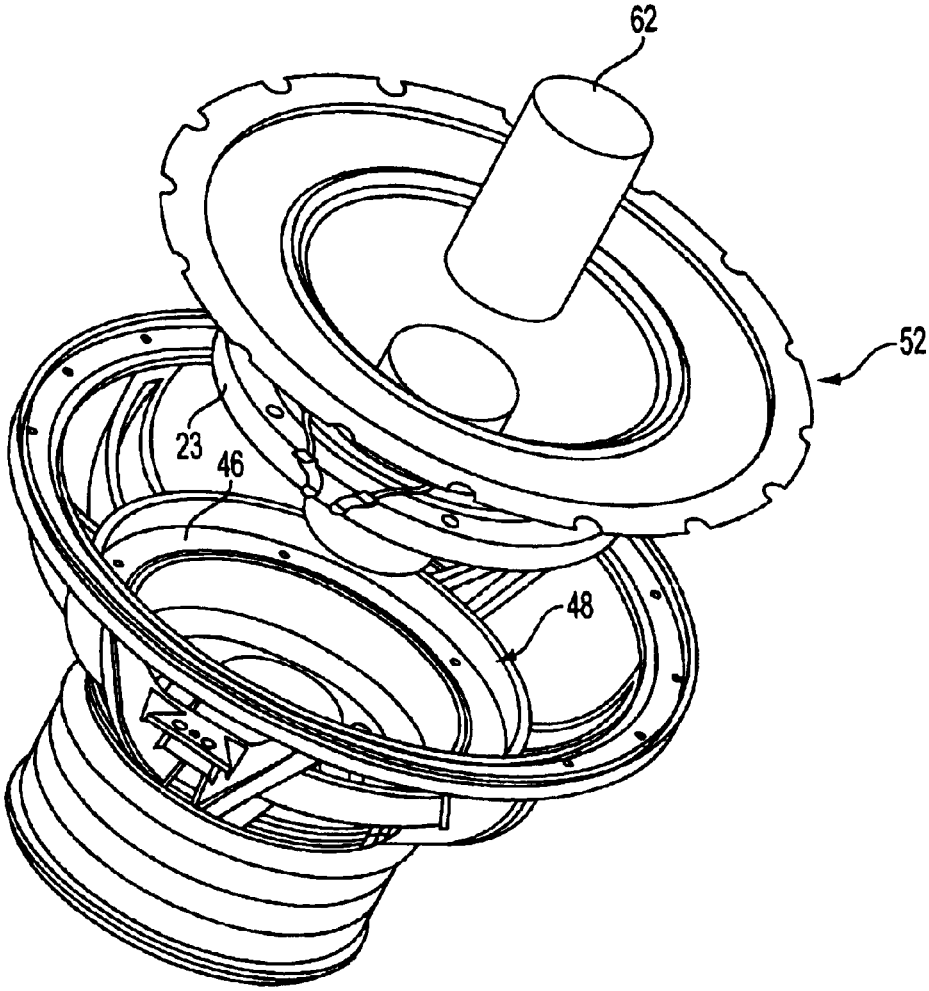
FIG. 8 is an exploded perspective view, in elevation, of the replacement cone assembly of the parts kit coaxially aligned over the basket and annular voice of the field rebuildable loudspeaker driver of FIG. 1, illustrating part of the field replacement method of the present invention.

Woofer motor 14 also includes a magnetic circuit defined by a doughnut shaped or annular ring shaped planar front plate 30, which along with the pole piece 32 defines a magnetic gap to focus magnetic flux from magnet 36 across voice coil 26. A substantially planar and circular back plate 34 also provides part of the magnetic circuit, carries cylindrical pole piece 32 and provides structural support for magnet 36. An annular magnetic gap is defined to be the annular space between pole piece 32 and the circular opening in front plate 30. The annular gap has a radial extend sized to receive the voice coil former's thickness plus the voice coil's thickness, plus the spacer paper alignment tool's thickness (62, as best seen in FIGS. 3 and 8), to provide adequate clearance for the moving voice coil in the magnetic gap, during operation as well as adequate clearance for the installation of the replacement cone assembly 52, as described below.

In use, the magnetic gap defined by the annular space between pole piece 32 and the circular opening in front plate 30 can be an area of substantial high temperature and voice coil heat is carried away from Woofer 10 by an air pumping action which accompanies motion of spider 22 whereby hot air surrounding voice coil 26 is pumped out to the side through screened side vents 38 arrayed around the side of Woofer 10 and defined in basket 11 just above or distally from woofer motor 14.

Figure 7:
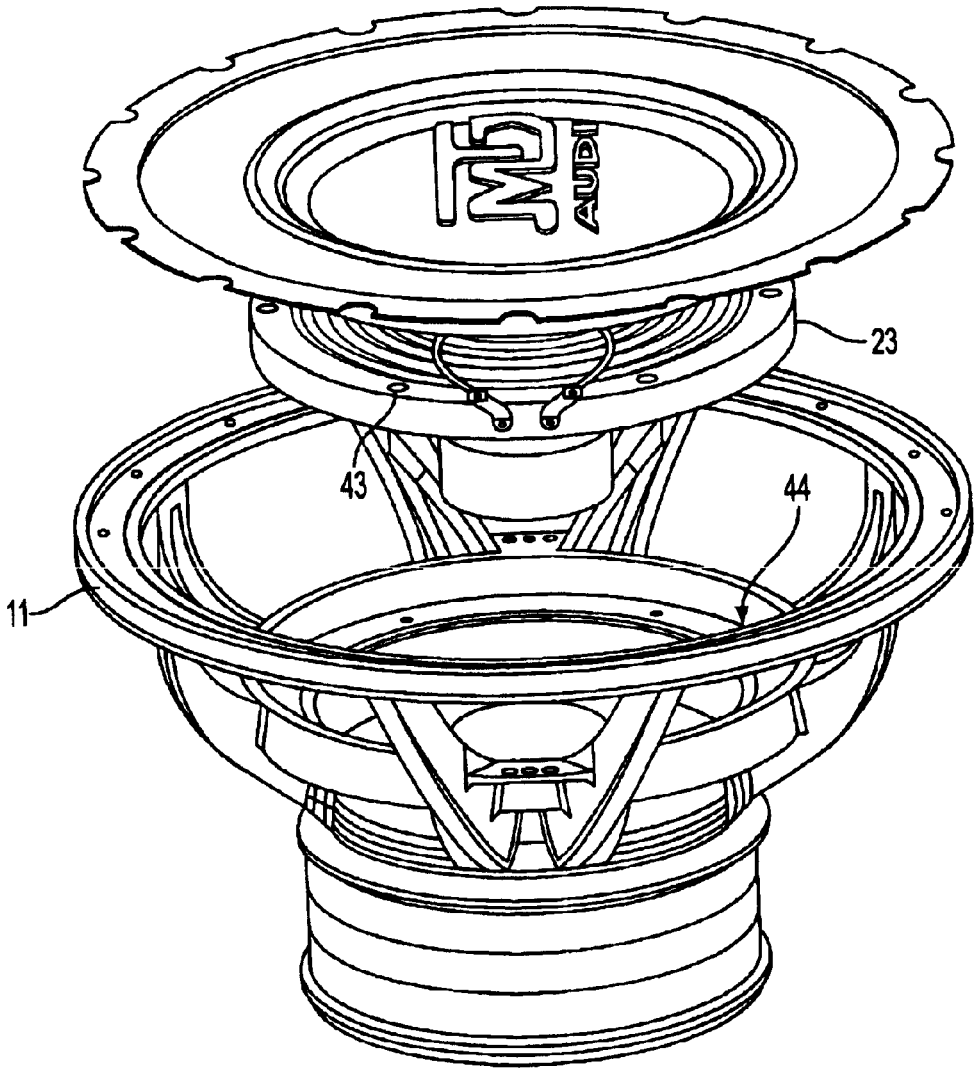
FIG. 7 is an exploded perspective view, in elevation, of the expended cone assembly coaxially aligned over the basket of the field rebuildable loudspeaker driver of FIG. 1, illustrating removal of the expended part of the field replacement method of the present invention.

The woofer cone assembly 16 includes a flexible spider suspension member 22 permanently affixed to the small proximal opening of cone 16 in close proximity to the joint between cone 16 and voice coil former 24 (as best seen in cross section in FIG. 2). Spider suspension 22 comprises at least one accordion-pleated doughnut shaped annular ring of treated fabric which is attached (at the inside diameter of the spider circular aperture) to voice coil former 24 and cone 16 and (at the spider outer peripheral edge) carries a rigid spider ring 23. Spider ring 23 is preferably also made of a metal material, preferably aluminum, and the metal spider ring preferably includes a plurality of evenly spaced apertures or through holes 43 which are aligned with their bores each being parallel to the central axis of the voice coil former 24. Spider ring apertures 43 are dimensioned and adapted to each receive a threaded fastener 42 which is also received in a threaded aperture 48 at the spider plateau portion 46 of woofer basket 11 (as best seen in FIGS. 2, 7 and 8). Spider ring 23 is thus releasably fastened to the spider plateau 46 of basket 11 by the plurality of spider ring fasteners 42 (see FIG. 5). Preferably, each spider ring fastener 42 is a hex-head threaded steel fastener having a cylindrical head side wall with a textured or knurled outer surface, to facilitate handling of the fasteners in the confined area beneath the cone 16. The spider ring fasteners 42 are preferably adapted to receive a hex key 54 (of 5⁄32" size) for removal or tightening of the spider ring fasteners 42. Preferably, spider ring 23 is essentially rectangular in cross section having a vertical thickness dimension of approximately 5⁄8" and a radial width of approximately 3⁄4" and has a radial array of six apertures 48 there through. Each of the apertures 48 is substantially elliptical having a width (across a radial line) of approximately 3⁄60" and a length (along a radial line) of slightly more than 1⁄4". Basket 11 includes a circular valley 44 having substantially straight sidewalls projecting transversely from the substantially planar plateau 46 to define a receptacle dimensioned to center and support the spider ring 23.

Basket 11 has distal outer or front flange 12 with the peripheral edge adapted to carry gasket ring 18 and has a proximal inner support surface or plateau 46 spaced apart from the distal outer flange 12 by a distance (along the cone central axis) roughly equal to the front-to-back depth of cone 16. The basket spider valley 44 is comprised of the planar plateau 46 and the perpendicular sidewall 45 projecting upwardly from the plateau 46. Together, basket valley sidewall 45 and basket plateau 46 define a receptacle which receives, centers and supports the spider ring 23.

Spider suspension 22 preferably comprises a bulky layer treated fabric spider element permanently bonded with a glue joint to voice coil former 24 proximate the junction with cone 16 and bonded at its outer peripheral edge to spider ring 23 in a glue joint or the like. Referring now to FIG. 2, spider ring 23 is an annular ring and spacer which attaches to two three-layer spiders, one-three layer spider is glued to the top of spider ring 23 and one three layer spider is spaced apart from the first and is glued to the bottom of ring 23. Spider ring 23 fits in and is centered by basket spider valley 44 and rests on basket spider plateau 46. As best seen in FIG. 2, spider ring 23 has a selected proximal-to-distal (or lower to upper) thickness defined between a proximal (motor side) surface and a distal (cone side) surface and distal three layer annular spider 22*a* is connected to spider ring 23 adjacent the distal surface, while the proximal three layer annular spider 22*b* is connected to the spider ring 23 adjacent the proximal surface of spider ring 23, a distance roughly corresponding to the thickness of spider ring 23.

As noted above, woofer 10 preferably includes 2 voice coils. One layered on top of the other on voice coil former 24 and each of the 2 voice coils is preferably of two ohm impedance and is terminated in first and second voice coil lead terminals. Preferably, woofer basket 11 includes a first terminal pair oriented on a first side of basket 11 and has a second terminal pair adapted to receive the second voice coil on the opposite side of basket 11. In this way, cone assembly terminals are preferably arrayed on opposite sides of cone 16 for easy connection to the four basket terminal connectors 28.

Figure 4:
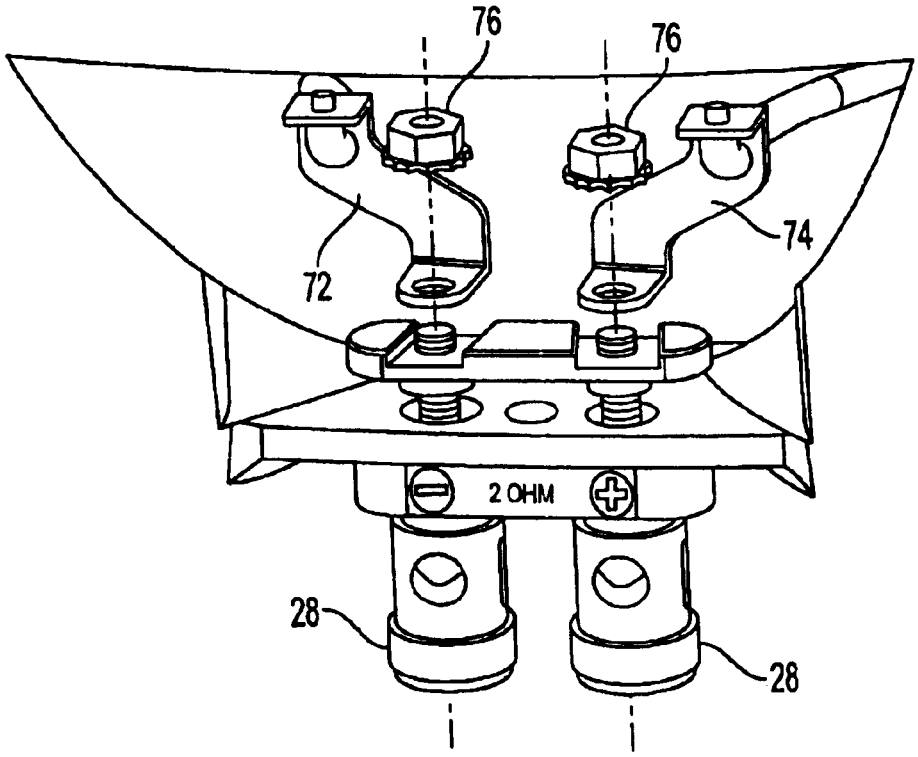
FIG. 4 is a perspective view, in elevation, of the terminals of the field rebuildable loudspeaker driver of FIG. 1, illustrating part of the field replacement method of the present invention.
Figure 9:
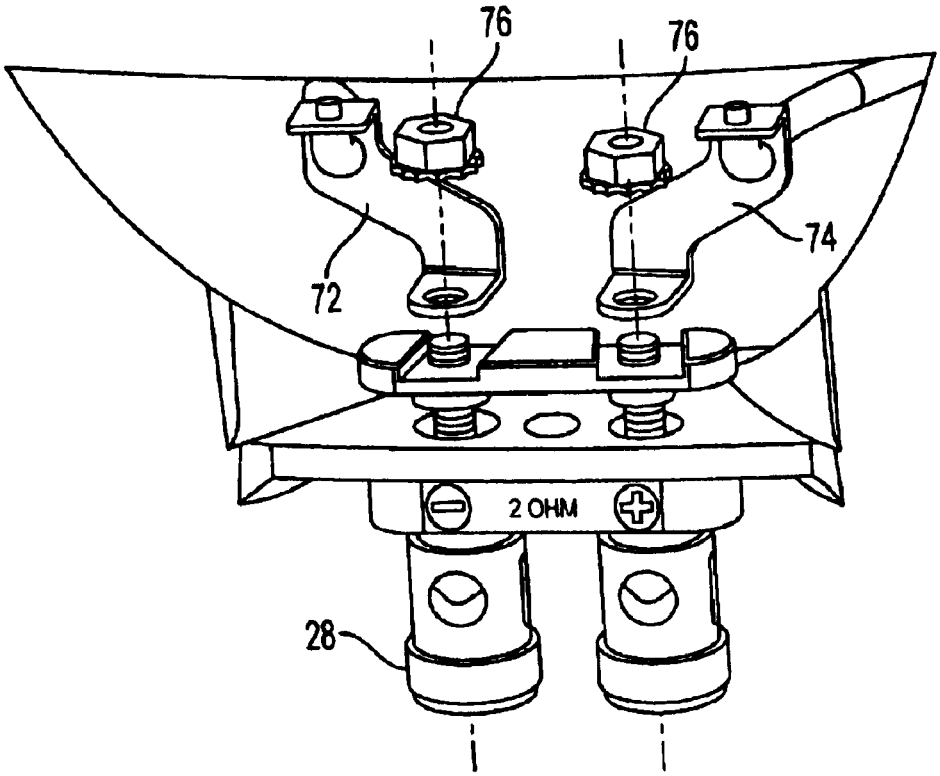
FIG. 9 is a perspective view, in elevation, of the terminals of the replacement cone assembly aligned with the terminals of the field rebuildable loudspeaker driver of FIG. 1, illustrating part of the field replacement method of the present invention.

Referring now to FIGS. 3–9, parts kit or reconing kit 50 includes a replacement cone assembly 52 (also known as "the software") a 5⁄32" hex key 54 and a 1⁄8" hex key 56. parts kit 50 also preferably includes a wrench 58 adapted to receive and actuate or turn the four (4) terminal nut fasteners 76 (as best seen in FIGS. 4 and 9). In the preferred embodiment, a terminal nut fastener 76 is 7 mm (from flat to flat) and includes a captive lock washer or keeper element. A replacement dome-shaped dust cap 20 is supplied as a loose part in parts kit 50.

Referring back to FIG. 3, parts kit 50 also includes a tube of glue or a glue pack 60 and a spacer paper alignment tool 62 which is preferably sized in length, width and thickness to be received within the inside diameter of voice coil former 24. As noted above, the annular gap has a radial extend which is optimized for acoustic efficiency but is also sized to receive the voice coil former's thickness plus the voice coil's thickness, plus the spacer paper alignment tool's thickness (62, as best seen in FIGS. 3 and 8), to provide adequate clearance for the moving voice coil in the magnetic gap, during operation as well as adequate clearance for the installation of the replacement cone assembly 52.

When performing this rebuilding process in the field, the first step is to use the supplied wrench 58 to loosen the 4 terminal nut fasteners 76 used to fasten first and second terminal connectors 72, 74 connected to each voice coil and to basket terminal connectors 28. Again, there are four basket terminals to provide plus and minus connections for, preferably, first and second voice coils. Each of the insulating terminal bases which align and support the basket terminal connectors 38 must be kept in place after terminal nut fasteners 76 have been removed. Preferably, during disassembly, once nuts 76 have been loosened, the terminals 28 remain in place with the insulating terminal bases and all of the terminal connection parts are saved for reassembly.

Next, using the larger hex key 54, the six spider ring fasteners 42 are loosened and removed thereby freeing spider ring 23 from valley 44 of woofer basket 11. Fasteners 42 are saved for reassembly later.

Next, using the smaller of the hex keys 56, eight threaded hex fasteners 40 are removed from the distal or upper side of gasket ring 19 whereupon the gasket ring is removed and set aside with the fasteners 40 for later reassembly.

Next, as shown in FIG. 7, the expended or burned-out cone assembly is removed from the woofer. At this point, the user is instructed to not allow any foreign matter to fall into the magnetic gap (defined by pole piece 32 and the aperture in front plate 30). If the user is not going to reuse or rebuild the woofer immediately, the user can tape over the magnetic gap for storage.

Turning now to reassembly (and referring to FIGS. 5–10), the user first checks the magnetic gap for foreign matter or particles that may interfere with the voice coil. If foreign matter is found, the user may use tape (having a sticky dust collecting surface) or compressed air to remove the foreign matter from the magnetic gap.

Once the magnetic gap is determined to be clean, the replacement cone assembly 52 is carefully aligned with and inserted into Woofer basket 11 using the supplied spacer paper alignment tool 62 to carefully lower voice coil former 24 and voice coil 26 into the annular gap and around pole piece 32. Once the replacement cone assembly has been completed lowered into basket 11, spider ring 23 will have been inserted into and received within the basket valley 44 and be in contact with basket spider plateau 46 and the six apertures 48 in spider ring 23 are aligned with the threaded holes 48 in the basket spider plateau so that the spider ring fasteners 42 can be inserted into the spider ring holes 43. Next, the spider ring threaded fasteners 42 are tightened with the larger hex key 54, the user is carefully instructed to tighten spider ring 23 down evenly, alternating among fasteners 42 and increasing torque by small amounts until all six of the spider ring fasteners are snug. Hex key 54 is used to tighten the screws using the orientation shown in FIG. 5.

In the next step, the front or outer rigid gasket is replaced over the outer peripheral edge of surround 18 and is clamped in place using the eight fasteners or screws 40 aligned as shown in FIG. 6. Again, the user is cautioned to tighten the gasket ring fasteners 40 evenly alternating screws until the surround is evenly compressed. The user is cautioned not to over tighten fasteners used to tightly draw gasket ring 19 against basket front flange 12, thereby compressing surround 18.

The user next removes the voice coil spacer paper alignment tool 62 from within the voice coil former 24. Next, the user presses evenly on the distal end of the voice coil former 24 to make sure nothing is interfering with the voice coil movement and that there is no rubbing between the front plate 30 and voice coil 26. If rubbing or interference is detected, then there is either an object in the magnetic gap or cone assembly 52 was tightened unevenly; in that case, the rigid gasket ring 19 is removed and replacement cone assembly 52 is removed and all of the steps in reassembly are again repeated, taking extra care to make sure that the magnetic gap is clean and free of obstructions and that the replacement cone assembly is perfectly coaxially aligned with the magnetic gap.

Once replacement cone assembly 52 is properly aligned and fastened into basket 11, the user then attaches each of the terminal conductors (e.g., 72, 74) to their respective terminal connectors 28 mounted on basket 11 using terminal nut fastener 76. After the alignment check has been done and the spacer paper alignment tool 62 has been removed, the user then opens and uses supplied glue pack 60, placing an even bead of glue on the back side of the periphery of dust cap 20. Alternatively, the user may elect to use a hot melt glue (as discussed in greater detail, below).

Next, dust cap 20 is placed and centered upon the upper or distal surface of cone 16 using the locator ring as a guide and aligning the "MPX Audio" logo with the terminals using a ruler or other straight edge. Once the dust cap has been appropriately located and aligned, the user presses downwardly or proximally on dust cap 20 to evenly spread the glue against cone 16, thereby creating an air-tight bond between dust cap 20 and cone 16. Preferably, the glue from glue pack 60 is allowed to dry for a minimum of one hour before Woofer 10 is used. Alternatively, as noted above, the user may elect to use a hot melt glue (e.g., such as Hot Melt Technologies' part number 4199) formulated for high temperatures, flexibility and bonding to plastics or paper materials; hot melt glues typically give much faster drying times.

Turning now to other details, as best seen in FIGS. 3 and 8, alignment tool 62 is shown as a cylinder-shaped insert 62 (identified as "19Z056 spacer paper"), and is preferably a flat piece of heavy, stiff craft paper or the like which is preferably shipped inside the replacement cone assembly 52, and is rolled into a right circular cylinder (as shown) and fitted within the voice coil former.

Referring again to in FIGS. 3 and 8, replacement cone assembly 52 includes a cylinder end projecting up from the mouth of the cone; this cylinder end is the distal end of the exposed voice coil former 24 and spacer paper 62 actually goes inside former 24. During the rebuilding process in the field, spacer paper 62 is used to guide the voice coil former 24 down into the annular gap of the woofer motor 10. Spacer paper 62 keeps the voice coil former 24 centered around the pole piece 32 as former 24 is lowered concentrically over and around pole piece 32.

Figure 10:
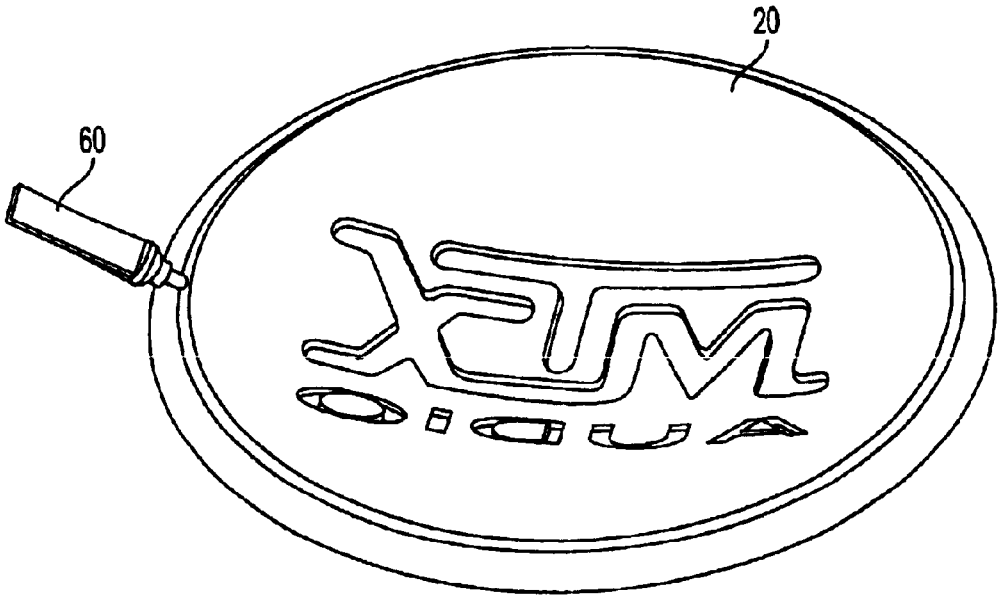
FIG. 10 is a perspective view, in elevation, of the replacement dust cap from the parts kit of FIG. 3, illustrating part of the field replacement method of the present invention.

Parts kit 50 includes two hex keys 54 and 56, a wrench 58 and a glue pack 60 for use in attaching dust cap 20 to the center front portion of cone 16, as shown in FIG. 10.

Referring now to FIG. 4, cone assembly terminals 72, 74 are part of the replacement cone assembly and the voice coil tinsel leads are terminated in terminations 9T0206 (72) and 9T0207 (74). Both terminals come attached and all one has to do is take off the 9TT438 nut fasteners 76 and put the wires onto the respective basket mounted terminals 28, and tighten the fastener nuts 76.

Figure 5:
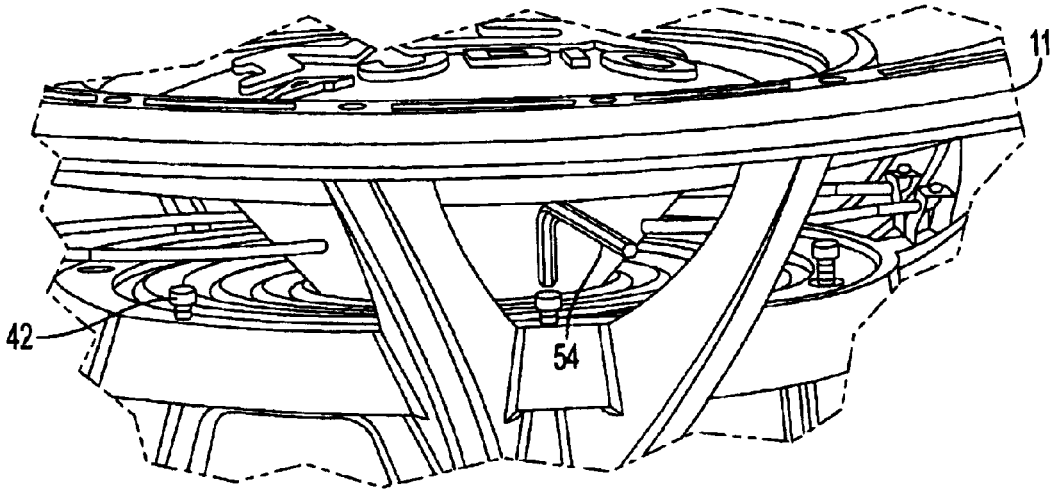
FIG. 5 is a perspective view, in elevation, of the removable, rigid spider ring of the field rebuildable loudspeaker driver of FIG. 1, illustrating part of the field replacement method of the present invention.

Referring now to FIGS. 2 and 5, spider ring 23 is an annular ring which attaches to six spiders (or two three layer spiders—one three layer spider is glued to the top of that ring and one three layer spider is glued to the bottom of that ring) and spider ring 23 fits in basket spider valley 44 and rests on basket spider plateau 46. The user drops the software in, lines it up and just bolts it in; spider ring 23 is preferably not actually clamping the spiders into the gasket since the spider is preferably glued to the ring 23. Spider ring 23 is a permanently affixed part of the software assembly 52, as illustrated in FIG. 7.

Referring now to FIG. 6, 9TT448 fasteners 40 hold gasket ring 19 to the peripheral edge of the woofer basket 11. Gasket ring 19 is preferably die cast aluminum. The user removes a non-functioning or burned out cone assembly from the woofer, being careful not to contaminate the magnetic gap with any kind of scrap. A blown woofer may leave residue of a burned voice coil in the gap which must be pulled out (e.g., like a Slinky™ brand spring toy). In accordance with the method of the present invention, a cleaning step can comprise blowing compressed air into the gap or cleaning the gap with an adhesive coated object or a piece of tape. Then the user reassembles woofer 10 using the parts provided in parts kit 50, essentially reversing the steps performed so far.

The driver illustrated in FIGS. 1–10 is nominally a fifteen inch competition subwoofer that weighs fifty six pounds and is capable of 4.35 inches of peak-to-peak excursion while dissipating approximately 4000 watts total (or 2000 watts RMS). The two (2 ohm) voice coils wound around former 24 are nominally three inches diameter and with the 298 ounce magnet 36, provide a sensitivity rating of 93.1. The mounting depth (measured from the bottom of the motor back plate 34 to the back of the basket flange 12) is 9.375 inches and the overall depth of basket 11 (measured from the bottom of the bottom or proximal basket plate which carries motor 14 to the upper or distal of the basket flange 12) is approximately six and one quarter inches.

With the extreme use seen in SPL competitions, the capability to rebuild or recone the driver in the field can prevent waste, since only the burned or expended software needs to be discarded.

Broadening this concept out now to an alternative embodiment (not shown), it is possible to adapt this technology to an entire line (e.g., of MTX Audio® brand woofers) so that other woofers which are destroyed in competition (as often happens) can also be rebuilt. A rigid ring like the die cast "spider ring" just discussed, instead of being fastened down by a variety of fasteners, is either threadably engaged by external threads or engaged using a bayonet locking feature incorporated into the periphery of the basket so that, with less than one turn, one clamps down the peripheral edge of the cone edge surround.

The spider clamp that attaches the peripheral edge of the spider uses a bayonet (insert and turn) action of less than one turn of threads. The spider is glued to a ring, like the current spider ring 23, but instead of screwing down using ring fasteners, it has a partial thread on its outer peripheral edge and the basket valley sidewall (perpendicular to the spider plateau) has an inward facing partial thread to receive and engage the spider ring's partial thread.

The assembly method for this embodiment requires the user to lower the software assembly into the basket, and the first thing after centering the voice coil is to rotate the threaded spider ring. The user will rotate that ring and one that's attached to the top of the cone at the same time, in a clockwise direction, less than a quarter turn. Letting the surround 18 spin freely, the whole cone assembly 52 spins when putting in the spider ring and then after its down, the gasket ring 18 is clamped onto surround 18.

In another alternative embodiment, a ring member attaches the peripheral edge of the surround uses a bayonet (insert and turn) action of less than one turn of threads. The surround is glued to the ring member, but instead of screwing down using fasteners 40 it has a partial thread on its outer peripheral edge and the basket front flange 12 has an inward facing partial thread to receive and engage the surround ring's partial thread. As above, a similar clamp that attaches the peripheral edge of the spider uses a bayonet (insert and turn) action of less than one turn of threads. The spider ring also has a partial thread on its outer peripheral edge and the basket valley sidewall has the inward facing partial thread to receive and engage the spider ring's partial thread. The outer surround hard gasket is attached to the software (cone and surround in this version), so hard gaskets carrying external threads are attached to both on the surround up top and on the spider down below. When installing the replacement cone assembly having a surround hard gasket and a spider hard gasket, they are both rotated at the same time to avoid twisting the surround foam. The rotation will be approximately one quarter of an inch, or much less than a complete turn. Preferably one or both of the gaskets are releaseably secured with a transversely guided set screw to keep them from unlocking after software replacement is complete.

An alternative embodiment for the terminal connectors carried on the replacement cone assembly uses modified standard 205 type blade connectors. Typically there's a cardboard or phenolic insulator that two standard 205 type blade connectors are attached to. Substituting for that phenolic insulator, an injection molded plastic part with a locking tab clips onto a metal tab that projects from of the basket. Typically standard 205 type blade connectors are riveted onto the basket. Here, the terminals on the cone assembly will just slide and clip onto the terminal structures attached to the basket, and the terminals on the cone assembly are soldered to the tinsel leads on the replacement software (i.e., cone assembly) kit. The user just pushes the plastic release and slides the terminals off with a metal tab, pulls out the software, puts in new software, does the slight twist to lock it, puts in set screws and then snaps that injection molded plastic insulator over the metal tab, and two terminals are ready to go. The metal terminals are wiping blade connectors that are held in place by an injection molded latch structure and have to snap-lock onto the metal tab that's currently on the back. The user pushes them in and they click.

For purposes of nomenclature, voice coil former 24 is, broadly speaking, a support for a voice coil, and so the term "voice coil former" is to be construed to include any configuration of spatial or mechanical support for a transducer element which functions in the same manner as a voice coil.

Similarly, for purposes of nomenclature, voice coil 26 is, broadly speaking, a transducer element which permits electrical signal energy to be converted to diaphragm movement, and so support for a voice coil, and so the term "voice coil" is to be construed to include any configuration of transducer element which permits electrical signal energy to be converted to diaphragm movement.

Further, for purposes of nomenclature, cone or diaphragm 16 is, broadly speaking, a transducer element which, by its movement, causes air movement in the surrounding air, and so the terms "cone" or "diaphragm" are to be construed to include any configuration of transducer element which, by its movement, causes movement in the surrounding air.

Having described preferred embodiments of a new and improved loudspeaker driver configuration, parts kit and field replacement method, it is believed that other modifications, variations and changes will be suggested to those skilled in the art in view of the teachings set forth herein. It is therefore to be understood that all such variations, modifications and changes are believed to fall within the scope of the present invention as set forth in the appended claims.

What is claimed is:

1. A voice coil driven loudspeaker driver, comprising:

a movable diaphragm having diaphragm surface defining a peripheral edge and a central region carrying a voice coil former;

a voice coil former adapted to carry a conductive voice coil having first and second electrical connections; said voice coil former being affixed to said diaphragm proximate said central region;

a supporting basket structure having a distal outer flange with a peripheral edge and having a proximal inner support surface spaced apart from said distal outer flange;

a first resilient annular suspension member being permanently affixed to said movable diaphragm proximate said diaphragm peripheral edge and being releaseably affixed to said basket proximate said basket peripheral edge;

a second annular resilient suspension member being permanently affixed to said movable diaphragm proximate said voice coil former and being releaseably affixed to said basket proximate said basket proximal inner support surface; and said first resilient suspension member and said second resilient suspension member both movably supporting said movable diaphragm within said basket structure.

2. The voice coil driven loudspeaker driver of claim 1, wherein said basket peripheral edge carries a clamping ring, and wherein said first resilient annular suspension member is releaseably clamped to said basket proximate said basket peripheral edge by releaseably fastening said clamping ring to said basket peripheral edge.

3. The voice coil driven loudspeaker driver of claim 2, wherein said basket clamping ring is releaseably fastened to said basket peripheral edge with a plurality of threaded fasteners.

4. The voice coil driven loudspeaker driver of claim 1, wherein said second annular resilient suspension member is permanently affixed to said movable diaphragm proximate said voice coil former by a permanent bond.

5. The voice coil driven loudspeaker driver of claim 1, wherein said second annular resilient suspension member has a peripheral edge and carries a rigid ring on said peripheral edge.

6. The voice coil driven loudspeaker driver of claim 5, wherein said second annular resilient suspension member is releaseably affixed to said basket proximate said basket proximal inner support surface by releaseably fastening said rigid ring to said basket proximal inner support surface.

7. The voice coil driven loudspeaker driver of claim 6, wherein said second annular resilient suspension member rigid ring is releaseably fastened to said basket proximal inner support surface with a plurality of threaded fasteners.

8. The voice coil driven loudspeaker driver of claim 7, wherein said second annular resilient suspension member rigid ring has a selected front-to-back thickness defined between a proximal surface and a distal surface;

wherein said second annular suspension member comprises a first annular spider connected to said rigid ring adjacent said proximal surface; and wherein said second annular suspension member further comprises a second annular spider connected to said rigid ring adjacent said distal surface.

9. A replacement cone assembly adapted for installation in a loudspeaker driver with a supporting basket structure having a distal outer flange with a peripheral edge and having a proximal inner support surface spaced apart from said distal outer flange, said replacement cone assembly comprising:

a diaphragm having diaphragm surface defining a peripheral edge and a central region carrying a voice coil former;

a voice coil former adapted to carry a conductive voice coil having first and second electrical connections; said voice coil former being affixed to said diaphragm proximate said central region;

a first resilient annular outer surround suspension member being permanently affixed to said diaphragm proximate said diaphragm peripheral edge;

a second annular resilient spider suspension member being permanently affixed to said movable diaphragm proximate said voice coil former; said spider suspension member being permanently affixed to said movable diaphragm proximate said voice coil former by a permanent bond; and wherein said second spider suspension member has a peripheral edge and carries a rigid ring on said peripheral edge.

10. The replacement cone assembly of claim 9, wherein said spider suspension member is adapted to be releaseably fastened to the basket proximal inner support surface with a plurality of threaded fasteners.

11. The replacement cone assembly of claim 9, wherein said spider rigid ring has a selected front-to-back thickness defined between a proximal surface and a distal surface;

wherein said spider member comprises a first annular spider connected to said rigid ring adjacent said proximal surface; and wherein said spider member further comprises a second annular spider connected to said rigid ring adjacent said distal surface.

12. A method for re-building a blown loudspeaker in the field, comprising the method steps of:

(a) providing a loudspeaker driver supporting basket structure having a distal outer flange with a peripheral edge, and having a proximal inner support surface spaced apart from said distal outer flange; said basket carrying a motor with a pole piece having a central axis;

(b) providing a rigid clamping gasket ring adapted to be releaseably attached to the outer flange;

(c) providing a replacement cone assembly adapted for installation in the a supporting basket structure and comprising a diaphragm having diaphragm surface defining a peripheral edge and a central region carrying a voice coil former; a voice coil former adapted to carry a conductive voice coil having first and second electrical connections; said voice coil former being affixed to said diaphragm proximate said central region; a first resilient annular outer surround suspension member being permanently affixed to said diaphragm proximate said diaphragm peripheral edge; a second annular resilient spider suspension member being permanently affixed to said movable diaphragm proximate said voice coil former; said spider suspension member being permanently affixed to said movable diaphragm proximate said voice coil former by a permanent bond; and wherein said second spider suspension member has a peripheral edge and carries a rigid ring on said peripheral edge;

(d) aligning the cone assembly voice coil, spider and surround with the central axis of the loudspeaker driver pole piece; and (e) position the diaphragm first surround proximate the loudspeaker basket front flange.

13. The method for re-building a blown loudspeaker in the field of claim 12, further comprising the method step of:

(f) clamp the diaphragm first surround against the loudspeaker basket front flange by affixing the gasket ring.

14. The method for re-building a blown loudspeaker in the field of claim 13, further comprising the method step of:

(g) fasten the spider ring to the loudspeaker basket to releaseably attach the spider to the loudspeaker driver.

15. The method for re-building a blown loudspeaker in the field of claim 12, wherein method step of aligning the cone assembly spider includes aligning the spider ring within the basket proximal inner support surface.

16. The method for re-building a blown loudspeaker in the field of claim 15, wherein method step of aligning the spider ring within the basket proximal inner support surface includes aligning apertures for threaded fasteners.

* * * * *